United States Patent [19]

Fukushima et al.

[11] 4,048,805

[45] Sept. 20, 1977

[54] CONCRETE PILE

[75] Inventors: Yoshikiyo Fukushima, Tokyo; Shigeru Watanabe, Suita, both of Japan

[73] Assignees: Nippon Concrete Industries Co. Ltd., Tokyo; Nikkai Giken Co., Ltd., Osaka, both of Japan

[21] Appl. No.: 650,790

[22] Filed: Jan. 20, 1976

[51] Int. Cl.[2] ..... E02D 5/30

[52] U.S. Cl. ..... 61/56; 61/39; 52/170; 52/301; 52/728

[58] Field of Search ..... 61/56, 56.5, 53, 59; 52/728, 725, 146, 150, 223, 301, 659, 724, 723, 170, 727, 39, 49; 256/50

[56] References Cited

U.S. PATENT DOCUMENTS

| | | | |
|---|---|---|---|
| 830,599 | 9/1906 | Koontz | 52/725 |
| 947,514 | 1/1910 | Stevens | 52/727 |
| 1,012,419 | 12/1911 | Offenhauser | 52/146 |
| 1,178,641 | 4/1916 | Henkel | 52/146 X |
| 1,837,630 | 12/1931 | Pawling | 52/72.5 X |
| 3,350,822 | 11/1967 | Nachazel | 52/728 X |
| 3,468,090 | 9/1969 | L'Hermite | 52/309 |
| 3,963,056 | 6/1976 | Shibuya et al. | 61/59 X |

FOREIGN PATENT DOCUMENTS

| | | | |
|---|---|---|---|
| 1,067,005 | 4/1967 | United Kingdom | 61/56 |

*Primary Examiner*—Jacob Shapiro

*Attorney, Agent, or Firm*—Fidelman, Wolffe & Waldron

[57] ABSTRACT

This invention relates to a concrete pile having a steel plate, of a semi-cylindrical shape,integrally fixed at the outer periphery thereof. The steel plate has a number of connectors protruding beyond the inner surface so as to thrust into concrete. The connectors are formed by performing the incomplete blanking of the steel plate. When the concrete pile is subjected to a concentrated load or a large bending moment, it can be reinforced by means of the steel plate. The operation of attaching a waling to the concrete pile can be also easily performed through means of the steel plate.

7 Claims, 11 Drawing Figures

Proir Art

Proir Art

CONCRETE PILE

SUMMARY OF THE INVENTION

This invention relates to a concrete pile.

It is generally known that concrete piles can be widely used, as for instance foundation pillars of constructions or soil-supporting walls. It is also known that concrete piles are subjected to a bending moment with the distribution peculiar to the object of their use. Regarding a soil-supporting wall, as shown in FIG. 1 (A), the lower part of a pile 13 is buried under the ground 11 and the upper part thereof is supporting soil 12. The pile 13 is subjected to a horizontal bending moment with the distribution shown in FIG. 1 (B).

The concrete pile 13 is subjected to the largest moment around the boundary of the ground 11 and the soil 12. Accordingly, hitherto the whole of the pile has been reinforced on the basis of this part, which is subjected to the largest moment, or only this part has been reinforced by means of iron bars.

However, if the whole of the pile is reinforced by increasing the number of iron bars, the iron bars disposed at a part subjected to a small moment are not valuable and it results in high cost. In case of partial reinforcement, high degree of skill and the excessive process for disposing the iron bars are required, and consequently the problem of high cost cannot be avoided.

In order to reinforce a soil-supporting wall, a waling 14 is transversely attached to the pile 13 at the position of a certain height, and the waling 14 is supported by a support 15 from the ground 11, as shown in FIG. 2. In this case, the pile 13 is also subjected to a concentrated load, and thereby it is also required to reinforce the part subjected to the concentrated load. Moreover, as the side surface of the pile has no means to which the waling 14 is fixed, the operation of reinforcing the soil-supporting wall is difficult.

The first object of the present invention is to provide a relatively cheap pile which is partly reinforced by means of a steel plate, of a semi-cylindrical shape, embeded therein at the part subjected to the concentrated load.

The second object of the present invention is to provide a pile in which the steel plate is previously embeded at the part to which a waling is due to be attached, in order to facilitate the attachment.

Other secondary object of the present invention is to provide connectors for firmly fixing the steel plate to the pile.

BRIEF DESCRIPTION OF THE DRAWINGS

FIG. 1 (B) is a diagram showing the distribution of the bending moment acting on each pile of the soil-supporting wall of FIG. 1 (A);

DETAILED DESCRIPTION OF THE INVENTION

Figure 1:
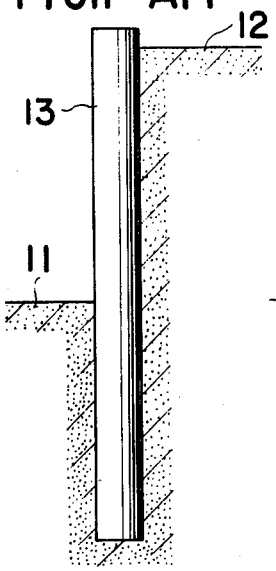
FIG. 1 (A) is a sectional elevation view of a conventional soil-supporting wall being constructed of a plurality of concrete piles.
Figure 1:
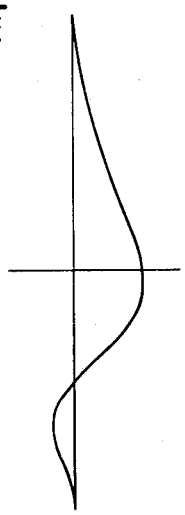
Figure 2:
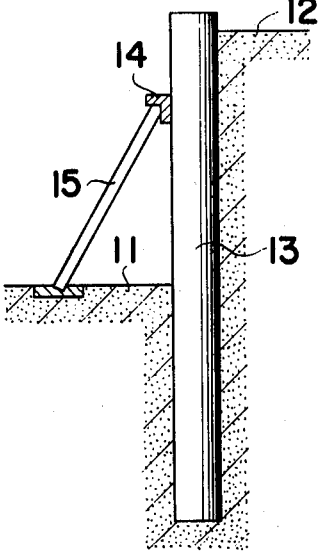
FIG. 2 is a sectional elevation view of a conventional soil-supporting wall with a waling attached thereto.
Figure 3:
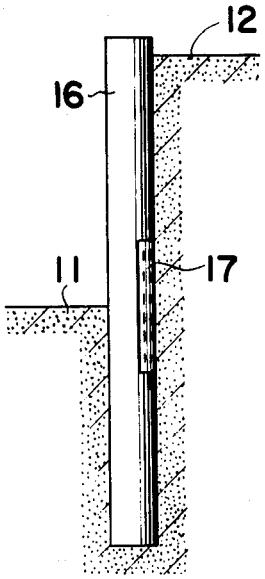
FIG. 3 is a sectional elevation view of a soil-supporting wall being constructed of a plurality of concrete piles of the present invention.

FIG. 3 shows a section of a soil-supporting wall being constructed of a plurality of concrete piles of the present invention. The steel plate 17 of a semi-cylindrical shape is embeded in the concrete pile 16 at a part subjected to the largest moment, i.e. at its periphery around the boundary between the ground 11 and the soil 12, in order to reinforce the concrete pile 16 to the extent that the pile 16 can bear the said moment.

Figure 4:
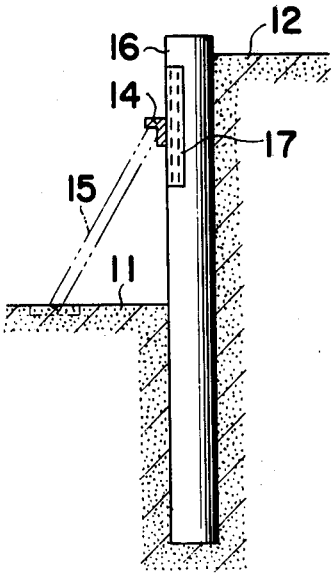
FIG. 4 is a sectional elevation view of a soil-supporting wall, being constructed of a plurality of concrete piles of the present invention, to which a waling is attached.

FIG. 4 also shows a section of a soil-supporting wall being constructed of a plurality of concrete piles of the present invention. In this embodiment, the steel plate 17 of a semi-cylindrical shape is embeded in the concrete pile 16 at a part supporting the soil 12 at a position of a proper height, and the waling 14 is transversely fixed to the steel plate 17. The waling 14 can be fixed thereto by welding or through means of bolts. The concrete pile 16 of the present embodiment is reinforced at the part where the waling 14 is attached.

Figure 5:
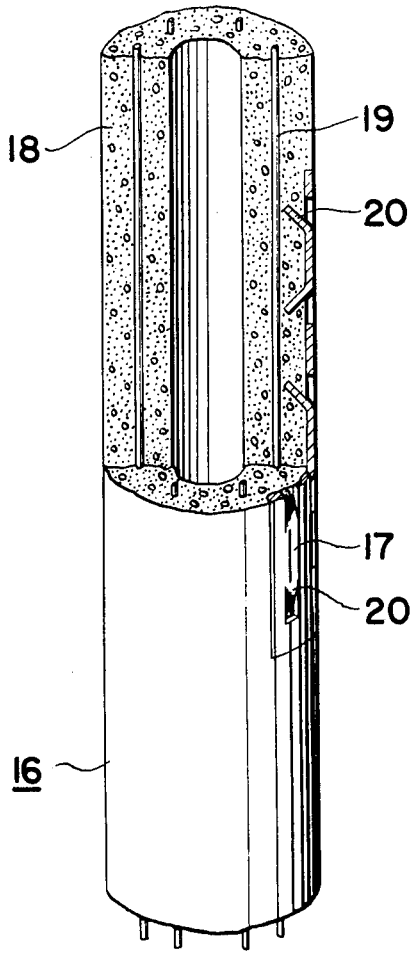
FIG. 5 is a partly sectional perspective view of the concrete pile of the present invention, showing the structure of the part where the steel plate is embeded.

FIG. 5 is a partly sectional perspective view of the concrete pile 16 with the steel plate 17 embeded therein. A suitable number of iron bars 19 are disposed in the concrete part 18 at a certain pitch. The steel plate 17, of a semi-cylindrical shape, is embeded in the conrete part 18 along the outer surface thereof.

The steel plate 17 is previously disposed at the fixed position along the inner surface of a mold together with the iron bars 19 at the time of forming the concrete pile 16. Thereafter concrete is placed within the mold. Accordingly the steel plate 17 is fixed as a part of the outer surface of the concrete pile 16.

In order to be firmly fixed in the concrete part 18, the steel plate 17 has a plurality of connectors 20 protruding beyond the inner surface thereof. The connectors 20 thrust into the concrete part 18. The connectors 20 are formed by performing the incomplete blanking at proper positions from the outer surface of the steel plate 17 and bending the incompletely blanked parts so as to protrude beyond the inner surface of the steel plate 17.

Figure 6:
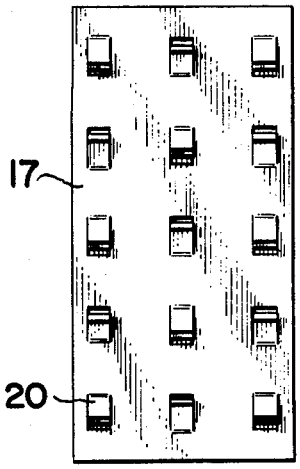
FIGS. 6 (A) and 6 (B) are rear elevation views of the unbended steel plates of two different shapes.
Figure 6:
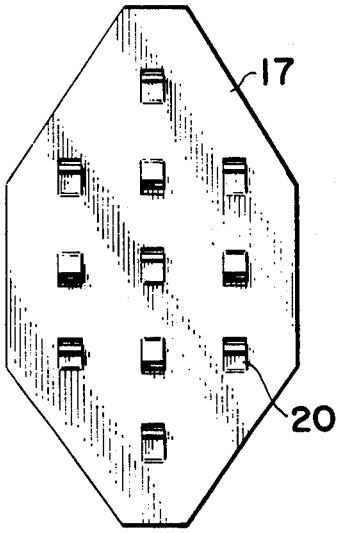

FIG. 6 (A) shows the inner side of the unbended steel plate 17. The connectors 20 are formed into a rectangle and protrude beyond the inner surface of the steel plate 17 in such a manner that they are facing upward and downward reciprocally. Under the condition that they are fixed in the concrete part 18, the concrete pile 16 is great in adhesion and shear resistance in the directions of its axis, perpendicular to the axis and its rotation. Therefore, the steel plate 17 will not be easily removed from the concrete part 18. In the present embodiment, the steel plate 17 itself is also formed into a rectangle in its unbended state.

FIG. 6 (B) shows the inner side of the unbended steel plate 17 the shape of which is different from that shown in FIG. 6 (A). The shape is a diamond, i.e. four corners of a rectangle are cut off. In the present embodiment, the connectors 20 are suitably disposed according to the shape of the steel plate 17. This kind of steel plate is used when a wide plate, like the plate of FIG. 6 (A), is not required. The steel plate 17 may be also formed into a cylinder, whereby it can bear a bending moment or a concentrated load acting in any direction. When a waling is attached to such a cylindrical steel plate, it is not necessary to consider at which position it should be attached. Thus, the steel plate 17 may have an optional shape in accordance with the object of its use and the connectors 20 may be optionally disposed according to the shape of the steel plate 17.

Figure 7:
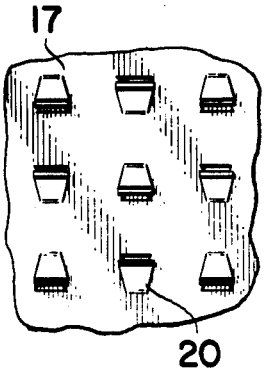
FIGS. 7 (A), 7 (B) and 7 (C) are fragmental rear elevation views of the unbended steel plates showing three different shapes of connectors.
Figure 7:
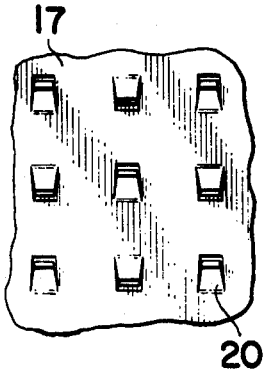
Figure 7:
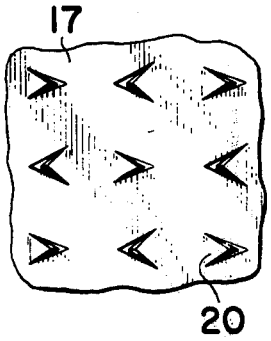

FIGS. 7 (A), 7 (B) and 7 (C) show some examples of the shape of the connector 20. They show the inner sides of the steel plates. In FIG. 7 (A), the connector 20 is formed into a trapezoid and the base is bent. In FIG. 7 (B), the connector 20 is also formed into a trapezoid and the upper side is bent. In FIG. 7 (C), the connector 20 is formed into a triangle and the short side is bent.

As apparent from FIG. 7, the shape, the size and the bending direction of the connector 20 can be optionally selected in accordance with the adhesion and the shearing resistance of the steel plate required in the concrete part 18, the direction and the strength of the force imparted to the concrete pile, and the degree of difficulty of the formation.

When the concrete pile is subjected to a concentrated load or a large bending moment, it can bear the load by the steel plate previously embeded therein at the position where the load is due to be imparted. The concrete pile of the present invention is cheaper than the conventional one in which the number of iron bars is increased. When a waling or some other thing is attached to the concrete pile, it can be easily fixed to the concrete pile through means of the steel plate. It is also possible to embed a plurality of steel plates in one concrete pile. Therefore, the present invention provides a concrete pile by which many effects can be obtained.

We claim:

1. A cylindrical concrete pile, with a steel plate of a semi-cylindrical shape integrally fixed in the outer peripheral surface at a predetermined position, along the length of said pile, the length of said steel plate being substantially less than the length of said concrete pile, said steel plate having a suitable number of connectors protruding beyond the inner surface thereof in such a manner that the said connectors thrust into and adhere in said concrete.

2. A concrete pile, as claimed in claim 1, in which the steel plate is disposed at a position subjected to the largest bending moment.

3. A concrete pile, as claimed in claim 1, in which the steel plate is disposed at the position where some attachment is due to be fixed.

4. A cylindrical concrete pile, as claimed in claim 1, in which the steel plate has a suitable number of connectors said connectors formed by incomplete blanking of said steel plate at suitable positions leaving one side of each connector integral with said plate and said connector bent so as to protrude beyond the inner concave surface of the steel plate.

5. A concrete pile, as claimed in claim 1, in which the connector is formed into a rectangle, a trapezoid or a triangle.

6. A concrete pile, as claimed in claim 1, in which the steel plate is formed into a rectangle or a diamond in its unbended state.

7. A concrete pile, as claimed in claim 1, in which the steel plate is formed into a cylinder.

* * * * *